US006684837B2

(12) United States Patent
Miyakoshi

(10) Patent No.: US 6,684,837 B2
(45) Date of Patent: Feb. 3, 2004

(54) CONTROL APPARATUS OF VARIABLE VALVE TIMING MECHANISM AND METHOD THEREOF

(75) Inventor: Ryo Miyakoshi, Atsugi (JP)

(73) Assignee: Hitachi Unisia Automotive, Ltd., Atsugi (JP)

( * ) Notice: Subject to any disclaimer, the term of this patent is extended or adjusted under 35 U.S.C. 154(b) by 0 days.

(21) Appl. No.: 10/356,483

(22) Filed: Feb. 3, 2003

(65) Prior Publication Data

US 2003/0145815 A1 Aug. 7, 2003

(30) Foreign Application Priority Data

Feb. 4, 2002 (JP) ..... 2002-026724

(51) Int. Cl.[7] ..... F01L 1/34

(52) U.S. Cl. ..... 123/90.17; 123/90.15; 464/1

(58) Field of Search ..... 123/90.17, 90.15, 123/90.16, 90.27, 90.31; 464/1, 2, 158

(56) References Cited

U.S. PATENT DOCUMENTS 6,367,437 B2 * 4/2002 Nakamura et al. ..... 123/90.17

FOREIGN PATENT DOCUMENTS

JP 2001-41013 A 2/2001

* cited by examiner

*Primary Examiner*—Thomas Denion
*Assistant Examiner*—Kyle Riddle
(74) *Attorney, Agent, or Firm*—Foley & Lardner

(57) ABSTRACT

In a variable valve timing mechanism that changes a rotation phase of a camshaft with respect to a crankshaft by an actuator to vary valve timing of engine valves, when a fixed condition of the rotation phase is detected, the actuator is forcibly driven, to generate a torque alternately in an advance direction and a retarded direction of the rotation phase.

20 Claims, 7 Drawing Sheets

CONTROL APPARATUS OF VARIABLE VALVE TIMING MECHANISM AND METHOD THEREOF

FIELD OF THE INVENTION

The present invention relates to a control apparatus and a control method of a variable valve timing mechanism that varies valve timing of engine valves (intake valve/exhaust valve) of an internal combustion engine.

RELATED ART OF THE INVENTION

Heretofore, there has been known a variable valve timing mechanism of an internal combustion engine in which a rotation phase of a camshaft with respect to a crankshaft is changed to vary valve timing of engine valves.

For example, in a variable valve timing mechanism disclosed in Japanese Unexamined Patent Publication No. 2001-041013, a driving rotor on a crankshaft side and a driven rotor on a camshaft side are coaxially connected to each other via a link type assembling angle adjusting mechanism.

Then, an assembling angle between the driving rotor and the driven rotor is changed by the assembling angle adjusting mechanism, to vary valve timing of engine valves.

However, in the variable valve timing mechanism described above, if a movable part is caught in a dent on a sliding contact portion surface of the assembling angle adjusting mechanism, a resistance to a change in the rotation phase becomes large, resulting in a fixed condition where the rotation phase cannot be changed by a normal control.

SUMMARY OF THE INVENTION

It is therefore an object of the present invention to provide a control apparatus and a control method of a variable valve timing mechanism, capable of resuming a change in a rotation phase even if a movable part is caught in a dent on a sliding contact portion surface of an assembling angle adjusting mechanism.

In order to accomplish the above-mentioned object, the present invention is constituted to forcibly drive an actuator in order to generate a torque alternately in an advance direction and a retarded direction of a rotation phase when a fixed condition of the rotation phase is detected.

The other objects and features of this invention will become understood from the following description with reference to the accompanying drawings.

DESCRIPTION OF THE PREFERRED EMBODIMENT

Figure 1:
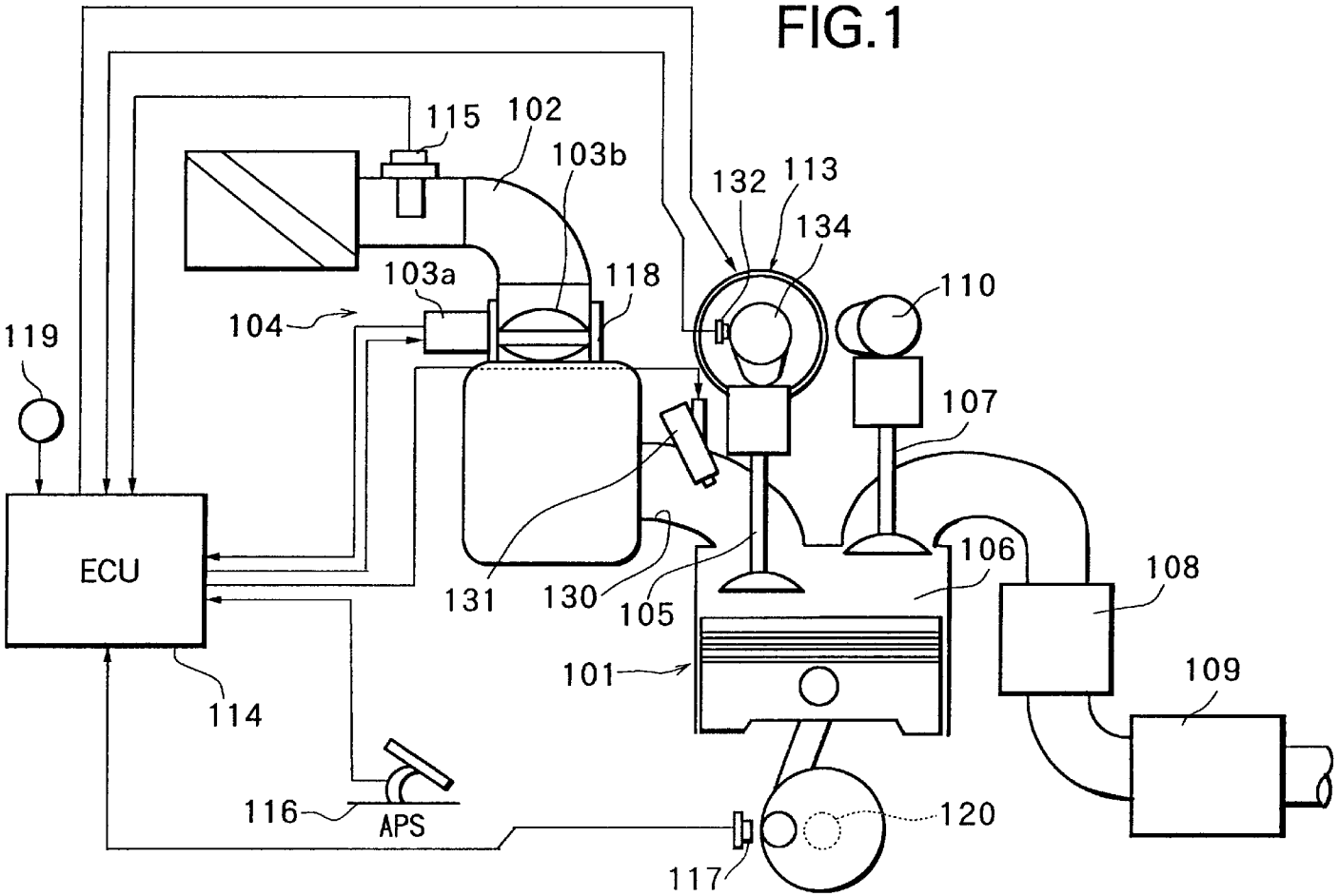
FIG. 1 is a diagram of a system structure of an internal combustion engine showing an embodiment of the present invention.

FIG. 1 is a structural diagram of an internal combustion engine for vehicle in an embodiment.

In FIG. 1, in an intake passage 102 of an engine 101, an electronically controlled throttle 104 is disposed for driving a throttle valve 103*b* to open and close by a throttle motor 103*a*.

Air is sucked into a combustion chamber 106 via electronically controlled throttle 104 and an intake valve 105.

A combusted exhaust gas is discharged from combustion chamber 106 via an exhaust valve 107, and then is purified by a front catalyst 108 and a rear catalyst 109.

Intake valve 105 and exhaust valve 107 are driven to open/close by cams that are disposed on an exhaust side camshaft 110 and an intake side camshaft 134, respectively.

On intake side camshaft 134, a variable valve timing mechanism 113 is disposed that changes a rotation phase of camshaft 134 with respect to a crankshaft 120, to vary valve timing of intake valve 105.

Note, the constitution may be such that variable valve timing mechanism 113 is also disposed on an exhaust valve side.

Further, an electromagnetic type fuel injection valve 131 is disposed on an intake port 130 at the upstream side of intake valve 105 for each cylinder.

Fuel injection valve 131 is driven to open by an injection pulse signal from an engine control unit (ECU) 114.

Engine control unit 114 incorporating therein a microcomputer receives various detection signals from various sensors.

Engine control unit 114 controls electronically controlled throttle 104, variable valve timing mechanism 113, and fuel injection valve 131 by a calculation process based on the detection signals.

For various sensors, there are provided an air flow meter 115 detecting an intake air amount Q of engine 101, an accelerator position sensor (APS) 116 detecting an accelerator position, a crank angle sensor 117 detecting an angle of a crankshaft 120, a throttle sensor 118 detecting an opening TVO of a throttle valve 103*b*, a water temperature sensor 119 detecting a cooling water temperature of engine 101, and a cam sensor 132 detecting an angle of intake side camshaft 134.

Next, a constitution of variable valve timing mechanism 113 will be described based on FIGS. 2 to 5.

Variable valve timing mechanism 113 comprises camshaft 134, a drive plate 2, an assembling angle adjusting mechanism 4, an operating apparatus 15 and a cover 6.

Drive plate 2 is transmitted with the rotation of crankshaft 120 to be rotated.

Assembling angle adjusting mechanism 4 is the one that changes an assembling angle between camshaft 134 and drive plate 2, and is operated by operating apparatus 15.

Cover 6 is mounted across a cylinder head (not shown in the figures) and a front end of a rocker cover, to cover front surfaces of drive plate 2 and assembling angle adjusting mechanism 4.

A spacer 8 is fitted with a front end (left side in FIG. 2) of camshaft 134.

The rotation of spacer 8 is restricted with a pin 80 that is inserted through a flange portion 134*f* of camshaft 134.

Camshaft 134 is formed with a plurality of oil galleries 134*r* in radial.

Figure 3:
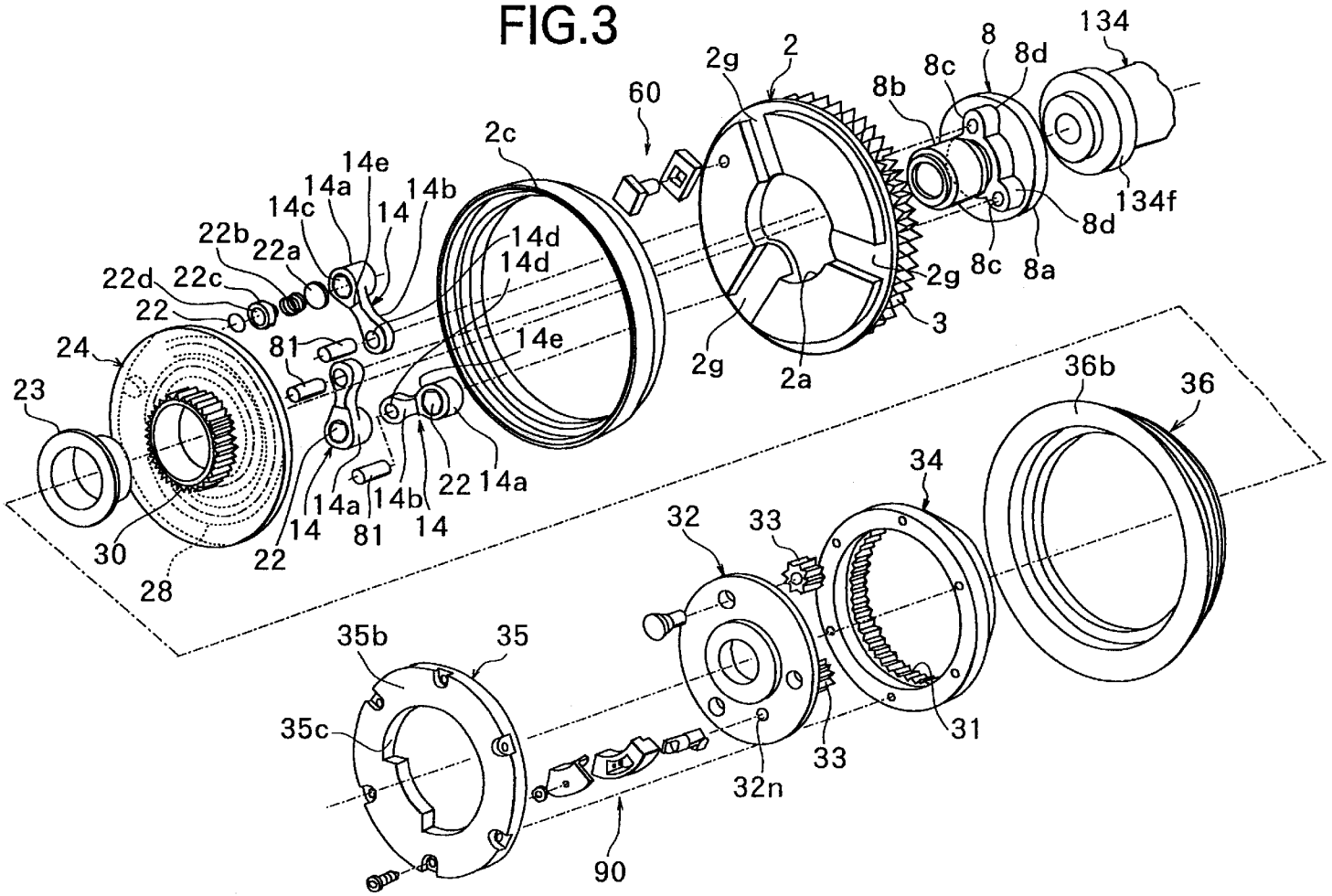
FIG. 3 is an exploded perspective view of the variable valve timing mechanism.

As shown in FIG. 3, spacer 8 is formed with a latch flange 8*a* of disk shaped, a cylinder portion 8*b* extending axially from a front end surface of latch flange 8*a*, and a shaft supporting portion 8*d* extending in three-ways to an outer diameter direction of spacer 8 from a base end side of cylinder portion 8*b*, that is, the front end surface of latch flange 8*a*.

Shaft supporting portion 8*d* is formed with press fitting holes 8*c* that are arranged circumferentially in each 120° and also parallel to an axial direction.

Further, spacer 8 is formed with a plurality of oil galleries 8*r* in radial.

Drive plate 2 has a disk shape formed with a through hole 2*a* at a center thereof, and is mounted to spacer 8 so as to be relatively rotated in a state that the axial displacement thereof is restricted by latch flange 8*a*.

A timing sprocket that is transmitted with the rotation of crankshaft 120 via a chain (not shown in the figures) is formed on a rear outer periphery of drive plate 2, as shown in FIG. 3.

Further, on a front end surface of drive plate 2, three guide grooves 2*g* connecting through hole 2*a* with the outer periphery of drive plate 2 are formed at each 120°.

Moreover, to an outer periphery portion of the front end surface of drive plate 2, a cover member 2*c* of annular shaped is fixed by welding or press fitting.

In the above constitution, camshaft 134 and spacer 8 correspond to a driven rotor, and drive plate 2 inclusive of timing sprocket 3 corresponds to a driving rotor.

Above described assembling angle adjusting mechanism 4 changes a relative assembling angle between camshaft 134 and drive plate 2.

Assembling angle adjusting mechanism 4 includes three link arms 14, as shown in FIG. 3.

Each link arm 14 is provided with, at a tip portion thereof, a cylinder portion 14*a* as a sliding portion, and is provided with an arm portion 14*b* extending from cylinder portion 14*a* in an outer diameter direction.

A housing hole 14*c* is formed on cylinder portion 14*a*, while a rotation hole 14*d* as a rotating portion is formed on a base end portion of arm portion 14*b*.

Link arm 14 is mounted so as to be rotatable around a rotation hole 81, by inserting rotation hole 81 press fitted into a press fitting hole 8*c* of spacer 8 through rotation hole 14*d*.

On the other hand, cylinder portion 14*a* of link arm 14 is inserted into guide groove 2*g* (radial guide) of drive plate 2, to be mounted so as to be movable in radial with respect to drive plate 2.

In the above constitution, when cylinder portion 14*a* receives an outer force to displace in radial along guide groove 2*g*, rotation pin 81 transfers circumferentially by an angle according to a radial displacement amount of cylinder portion 14*a*, so that camshaft 134 is relatively rotated with respect to drive plate 2 due to the displacement of rotation pin 81.

Figure 4:
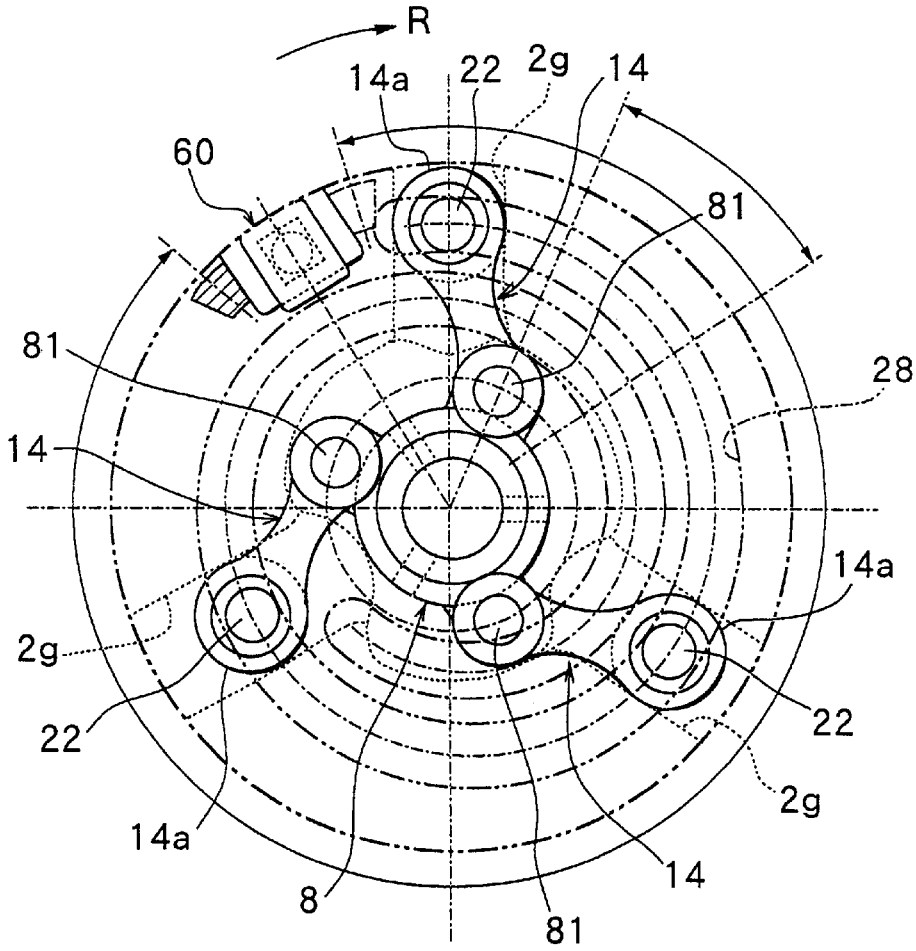
FIG. 4 is a cross section view showing a most retarded position of the variable valve timing mechanism (A—A cross section in FIG. 2).
Figure 5:
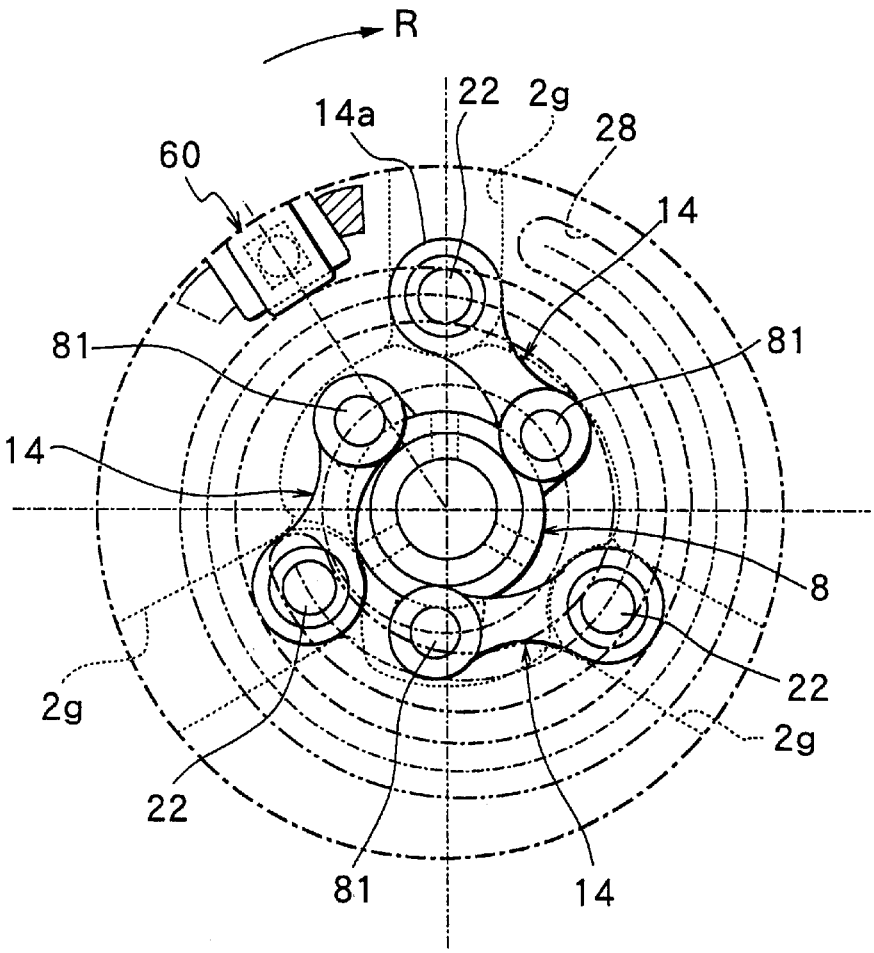
FIG. 5 is a cross section view showing a most advance position of the variable valve timing mechanism (A—A cross section in FIG. 2).

FIGS. 4 and 5 show an operation of assembling angle adjusting mechanism 4.

As shown in FIG. 4, when cylinder portion 14*a* in guide groove 2*g* is arranged on an outer periphery side of drive plate 2, since rotation pin 81 on the base end portion is close to guide groove 2*g*, valve timing is in a most retarded state.

On the other hand, as shown in FIG. 5, when cylinder portion 14*a* in guide groove 2*g* is arranged on an inner periphery side of drive plate 2, since rotation pin 81 is pressed circumferentially to depart from guide groove 2*g*, the valve timing is in a most advance state.

The radial transfer of cylinder portion 14*a* in assembling angle adjusting mechanism 4 is performed by operating apparatus 15.

Operating apparatus 15 is provided with an operation conversion mechanism 40 and a speed increasing/reducing mechanism 41.

Operation conversion mechanism 40 is provided with a sphere 22 held in cylinder portion 14*a* of link arm 14, and a guide plate 24 coaxially formed so as to face the front face of drive plate 2, to convert the rotation of guide plate 24 into the radial displacement of cylinder portion 14*a* of link arm 14.

Guide plate 24 is supported so as to be relatively rotatable with respect to an outer periphery of cylinder portion 8*b* of spacer 8 via a metal bush 23.

On a rear face of guide plate 24, a spiral guide groove 28 having an approximately semicircular section is formed, and on an intermediate portion in a radial direction of guide plate 24, an oil gallery 24*r* for supplying oil is formed in a longitudinal direction.

Sphere 22 is fitted with spiral guide groove 28.

Figure 2:
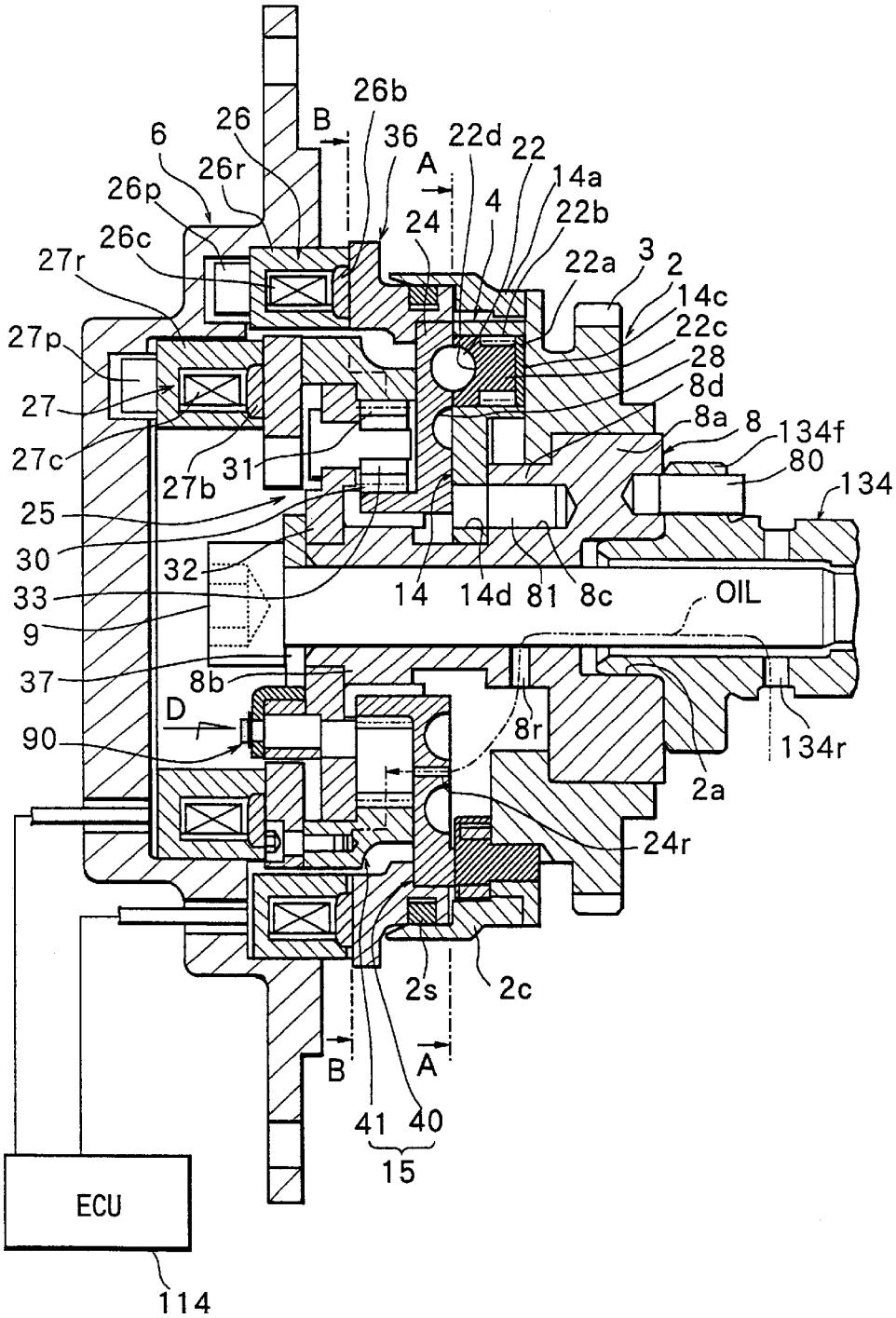
FIG. 2 is a cross section view showing a variable valve timing mechanism in the embodiment of the present invention.

As shown in FIGS. 2 and 3, a supporting panel 22*a* of disk shaped, a coil spring 22*b*, a retainer 22*c*, and a sphere 22 are inserted in this sequence into housing hole 14*c* disposed to cylinder portion 14*a* of link arm 14.

Retainer 22*c* is formed, on a front end portion thereof, with a supporting portion 22*d* for supporting sphere 22 in a state where sphere 22 protrudes, and also formed, on an outer periphery thereof, with a flange 22*f* on which coil spring 22*b* is seated.

In an assembling condition as shown in FIG. 2, sphere 22 is fitted with spiral guide groove 28, and also is relatively rotatable in an extending direction of spiral guide groove 28.

Further, as shown in FIGS. 4 and 5, spiral guide groove 28 is formed so as to gradually reduce a diameter thereof along a rotation direction R of drive plate 2.

Accordingly, in operation conversion mechanism 40, if guide plate 24 is relatively rotated with respect to drive plate 2 in the rotation direction R in the state where sphere 22 is fitted with spiral guide groove 28, sphere 22 transfers in radial to an outside along spiral guide groove 28.

Thus, cylinder portion 14*a* transfers in an outer diameter direction shown in FIG. 4, and rotation pin 81 connected with link arm 14 is dragged so as to become closer to guide groove 2*g*, so that camshaft 134 transfers in a retarded direction.

On the contrary, if guide plate 24 is relatively rotated with respect to drive plate 2 in an opposite direction to the rotation direction R from the above condition, sphere 22 transfers in radial to an inside along spiral guide groove 28.

Thus, cylinder portion 14*a* transfers in an inner diameter direction shown in FIG. 5, and rotation pin 81 connected with link arm 14 is pressed so as to depart from guide 2*g*, so that camshaft 134 transfers in an advance direction.

Speed increasing/reducing mechanism 41 will be described in detail.

Speed increasing/reducing mechanism 41 is for transferring guide plate 24 with respect to drive plate 2 in the rotation direction R (speed increasing) or for transferring guide plate 24 with respect to drive plate 2 in an opposite direction to the rotation direction R (speed reducing), and is provided with a planetary gear mechanism 25, a first electromagnetic brake 26 and a second electromagnetic brake 27.

Planetary gear mechanism 25 is provided with a sun gear 30, a ring gear 31, and a planetary gear 33 engaged with the both gears 30 and 31.

As shown in FIGS. 2 and 3, sun gear 30 is formed integrally with an inner periphery on a front face side of guide plate 24.

Planetary gear 33 is rotatably supported by a carrier plate 32 fixed to the front end portion of spacer 8.

Ring gear 31 is formed on an inner periphery of an annular rotor 34 that is rotatably supported by an outer side of carrier plate 32.

Carrier plate 32 is fitted with the front end portion of spacer 8 and is fastened to be fixed to camshaft 134 by inserting a bolt 9 therethrough while contacting with a washer 37 at a front end portion thereof.

A braking plate 35 having a front facing braking face 35*b* is screwed in a front end surface of rotor 34.

Further, a braking plate 36 having a front facing braking face 36*b* is fixed, by welding or fitting, to an outer periphery of guide plate 24 integrally formed with sun gear 30.

Accordingly, in planetary gear mechanism 25, if planetary gear 33 is not rotated but is revolved together with carrier plate 32, in a condition where first and second electromagnetic brakes 26 and 27 are not operated, sun gear 30 and ring gear 31 are in free conditions to be rotated at the same speed.

If only first electromagnetic brake 26 is operated from the above condition, guide plate 24 is relatively rotated in a direction to be retarded with respect to carrier plate 32 (direction opposite to the R direction in FIGS. 4 and 5), so that drive plate 2 and camshaft 134 are relatively displaced in the advance direction shown in FIG. 5.

On the other hand, if only second electromagnetic brake 27 is operated from the above condition, a braking force is given to link gear 31 only, so that ring gear 31 is relatively rotated in a direction to be retarded with respect to carrier plate 32.

Thus, planetary gear 33 is rotated, and the rotation of planetary gear 33 increases a speed of sun gear 30, so that guide plate 24 is relatively rotated to the rotation direction R side with respect to drive plate 2.

Then, drive plate 2 and camshaft 134 are relatively rotated in the retarded direction shown in FIG. 4.

First and second electromagnetic brakes 26 and 27 are arranged in double on the inner and outer sides so as to face braking faces 36*b* and 35*b* of braking plates 36 and 35, respectively, and include cylinder members 26*r* and 27*r* that are supported by pins 26*p* and 27*p* on a rear surface of cover 6, in floating states where only the rotation thereof are restricted by pins 26*p* and 27*p*.

These cylinder members 26*r* and 27*r* house therein coils 26*c* and 27*c*, respectively, and are also respectively mounted with friction members 26*b* and 27*b* that are pressed to braking faces 35*b* and 36*b* when power is supplied to each of coils 26*c* and 27*c*.

Cylinder members 26*r* and 27*r*, and braking plates 35 and 36 are formed of magnetic substance, such as iron, for generating a magnetic field when the power is supplied to each of coils 26*c* and 27*c*.

On the contrary, cover 6 is formed of non-magnetic substance, such as aluminum, for preventing leakage of magnetic flux at the time of power supply, and friction members 26*b* and 27*b* are formed of non-magnetic substance, such as aluminum, for preventing from being made to be permanent magnet, to be attached to braking plate 35 and 36 at the time of non-power supply.

The relative rotation of drive plate 2 and guide plate 24 provided with sun gear 30 as an output element of planetary gear mechanism 25 is restricted by an assembling angle stopper 60 at a most retarded position and a most advance position.

Further, in planetary gear mechanism 25, braking plate 35 is formed integrally with ring gear 31 and also a planetary gear stopper 90 is disposed between braking plate 35 and carrier plate 32.

Operation conversion mechanism 40 described above is constituted such that a position of cylinder portion 14*a* of link arm 14 is maintained so that a relative assembling position between drive plate 2 and camshaft 134 does not fluctuate. Such a constitution will be described.

A driving torque is transmitted via link arm 14 and spacer 8 to camshaft 134 from drive plate 2.

While, a fluctuating torque of camshaft 134 due to a reaction force from intake valve 105 is input from camshaft 134 to link arm 14, as a force F of a direction to connect pivoting points on both ends of link arm 14.

Since cylinder portion 14*a* of link arm 14 is guided in radial along guide groove 2*g*, and also sphere 22 protruding forwards from cylinder portion 14*a* is fitted with spiral guide groove 28, the force F input via each link arm 14 is supported by the left and right walls of guide groove 2*g* and spiral guide groove 28 of guide plate 24.

Accordingly, the force F input to link arm 14 is divided into two components FA and FB orthogonal to each other, and these components FA and FB are received in directions orthogonal to a wall on the outer periphery of spiral guide groove 28 and orthogonal to one wall of guide groove 2*g*, respectively.

Therefore, cylinder portion 14*a* of link arm 14 is prevented from transferring along guide groove 2*g*.

Therefore, after guide plate 24 is rotated by the braking forces of respective electromagnetic brakes 26 and 27, and link arm 14 is operated to rotate to a predetermined position, the position of link arm 14 is maintained and a rotation phase between drive plate 2 and camshaft 134 is held as it is.

Note, the force F is not limited to the one acting in the outer diameter direction, but may act in the inner diameter direction opposite to the outer diameter direction. In such a case, components FA and FB are received in directions orthogonal to a wall on the inner periphery of spiral guide groove 28 and orthogonal to the other wall of guide groove 2*g*, respectively.

An operation of variable valve timing mechanism 113 will be described hereafter.

In the case where a rotation phase of camshaft 134 with respect to crankshaft is controlled to a retarded side, the power is supplied to second electromagnetic brake 27.

If the power is supplied to second electromagnetic brake 27, friction member 27*b* of second electromagnetic brake 27 frictionally contacts with brake plate 35, and the braking force is acted on ring gear 31 of planetary gear mechanism 35, so that sun gear 30 is increasingly rotated with the rotation of timing sprocket 3.

Guide plate 24 is rotated in the rotation direction R side with respect to drive plate 2 by the increase rotation of sun gear 30, and as a result, sphere 22 supported by link arm 14 transfers to the outer periphery side of spiral guide groove 28.

This transfer to the retarded side is restricted at the most retarded position shown in FIG. 4 by assembling angle stopper 60.

Further, as described above, in braking the rotation of ring gear 31 by second electromagnetic brake 27, the rotation of ring gear 31 is not restricted instantaneously but is braked while permitting the rotation of a predetermined amount. When an amount of the rotation reaches the predetermined amount, the rotation of ring gear 31 is restricted.

On the other hand, in the case where the assembling angle of camshaft 134 is displaced to the advance direction, the power is supplied to first electromagnetic brake 26.

Thereby, the braking force acts on guide plate 24, and guide plate 24 is rotated in the direction opposite to rotation direction R with respect to drive plate 2, so that the assembling angle of camshaft 134 is changed to the advance side.

This displacement to the advance side is restricted at the most advance position shown in FIG. 5 by assembling angle stopper 60.

Further, when the rotation of guide plate 24 is restricted, planetary gear 33 is rotated and ring gear 31 is increasingly rotated. However, when the amount of the rotation of ring gear 31 reaches the predetermined amount, the rotation of sun gear 31 is restricted by planetary gear stopper 90.

Engine control unit 114 sets a target advance value (target rotation phase) of camshaft 134 with respect to crankshaft 120 based on engine operating conditions and feedback controls the power supply to first and second electromagnetic brakes 26 and 27 based on a deviation between the target advance value and a detection value of the rotation phase.

Figure 6:
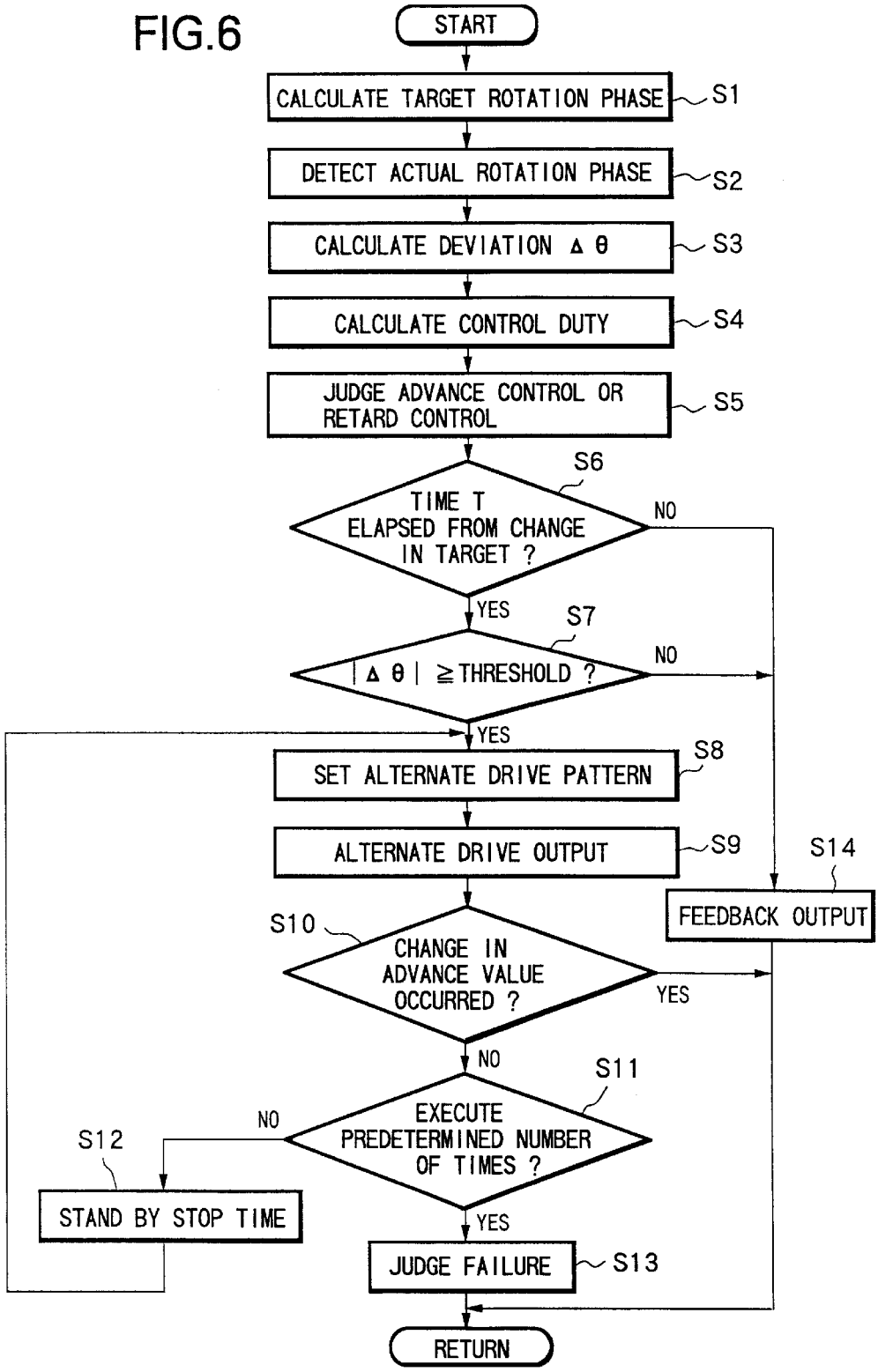
FIG. 6 is a flowchart showing a feedback control and a fixed condition release control of the variable valve timing mechanism in the embodiment.

Specifically, the feedback control is performed as shown in a flowchart of FIG. 6.

First, in step S1, the target advance value (target rotation phase) is calculated based on the engine operating conditions such as an engine load (throttle opening), an engine rotation speed or the like.

Next, in step S2, an actual advance value (actual rotation phase) is detected based on detection signals from crank angle sensor 117 and cam sensor 132.

In step S3, a deviation $\Delta\theta$ between the target advance value and the actual advance value is calculated.

In step S4, a duty ratio DUTY of when ON/OFF controlling the power supply to electromagnetic brakes 26 and 27 at high frequencies to control an average applied voltage, is calculated by a proportional-integral-derivative control.

$$\mathrm{DUTY}=Kp\times\Delta\theta+Ki\int\Delta\theta+Kd(d\Delta\theta/dt)$$

wherein Kp is a proportional gain, Ki is an integral gain, and Kd is a derivative gain.

Note, the feedback control is not limited to the one by the proportional-integral-derivative control, but may be the one by a sliding mode control.

In step S5, it is judged whether the power is to be supplied to electromagnetic brake 26 or electromagnetic brake 27, depending on plus or minus of the duty ratio DUTY calculated in step S4.

In step S6, it is judged whether or not a time T has elapsed from a time when the target advance value (target rotation phase) was changed stepwise.

The time T is set according to step change width of the target advance value, and it is assumed that the time T is set based on a time required for the actual advance value (rotation phase) to change following a change in the target advance value, and in a usual condition, the actual advance value reaches the target advance value within the time T.

If it is judged in step S6 that the time T has elapsed from the time when the target advance value was changed stepwise, then control proceeds to step S7 where it is judged whether or not an absolute value of the deviation $\Delta\theta$ between the target advance value and the actual advance value at that time is a threshold or above.

The threshold is set taking detection accuracy of advance value or a steady-state deviation into consideration.

If it is judged in step S7 that the absolute value of the deviation $\Delta\theta$ is the threshold or above, it is estimated that the rotation phase is in the fixed condition where the advance value (rotation phase) is not changed in a desired response.

Then, when the absolute value of the deviation $\Delta\theta$ is the threshold or above, control proceeds to step S8.

On the other hand, if it is judged in step S6 that the time T has not elapsed from the time when the target advance value was changed stepwise, or if it is judged in step S7 that the absolute value of the deviation $\Delta\theta$ is less than the threshold, then control proceeds to step S14.

In step S14, according to the judgment result in step S5, the power is supplied to either electromagnetic brake 26 or electromagnetic brake 27 based on the duty ratio DUTY, and a normal feedback control is performed.

Figure 7:
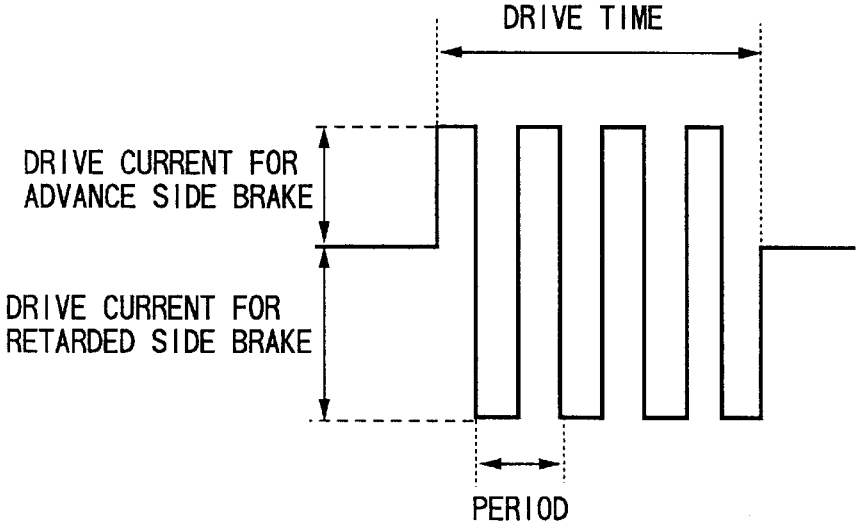
FIG. 7 is a time chart showing a control characteristic of an electromagnetic brake when the fixed condition release control is performed.

If the fixed condition is estimated in step S7, then control proceeds to step S8 and the succeeding steps, a fixed condition release control is performed for forcibly and alternately supplying the power to the electromagnetic brakes 26 and 27 (refer to FIG. 7).

First, in step S8, a duty ratio (generated torque), a driving period, and a driving time in the fixed condition release control are set.

Specifically, a duty ratio in advance and retarded directions is set to a predetermined ON duty close to 100% (direct coupling condition), and a control period is shortened (a control frequency is made higher) and the driving time is shortened, as the engine rotation speed is higher.

When the engine rotation speed is higher, since a change amount in advance value per unit time of when the electromagnetic brakes are directly coupled, the advance value (rotation phase) is greatly changed when the fixed condition is released, compared with the time of low engine rotation speed.

Therefore, as the engine rotation speed is higher, the power supply time per one time is shortened.

Further, as the engine rotation speed is higher, the alternate power supply is performed in short periods. Therefore, in order to approximately match the number of power supply times for electromagnetic brake 26 with that for electromagnetic brake 27, the driving time for continuing the alternate power supply is made shorter as the engine rotation speed is higher.

Note, it is possible to suppress the change in rotation phase of when the fixed condition of rotation phase is released by setting the duty ratio in the alternate power supply to be smaller as the engine rotation speed is higher.

Here, even if the duty ratio is the same, each drive current actually flowing into each coil differs depending on each coil temperature (resistance value of coil), thus the generated torque is changed.

Therefore, it is preferable to correct the duty ratio according to each coil temperature estimated based on the cooling water temperature or the lubricating oil temperature of the engine, or each coil temperature detected by the temperature sensor.

Further, the most advance side and the most retarded side of the rotation phase are limited by means of stoppers. In the case where the duty ratio in the advance and retarded directions is set to be the predetermined ON duty close to 100%, if the fixed condition is released at a position close to the most advance position or the most retarded position, there is a possibility that camshaft 134 strongly collides with the stopper.

Therefore, if the rotation phase in the fixed condition is close to the most advance position or the most retarded position, the duty ratio is restricted.

For example, if the rotation phase is fixed at the position close to the most advance angle, the control duty of second electromagnetic brake 27 that relatively rotates guide plate 24 to the retarded side of the rotation phase is set to be the predetermined ON duty close to 100%.

On the other hand, even if the rotation phase is not fixed, the duty ratio of first electromagnetic brake 26 that relatively rotates guide plate 24 to the advance side is limited to the duty ratio within a range where the change in rotation phase exceeding the stopper position at the most advance side does not occur.

In step S9, the power is supplied alternately to electromagnetic brakes 26 and 27, based on the duty ratio, the driving period and the driving time set in step S8.

By alternately supplying the power, a torque acting in a direction to displace the rotation phase to the advance side and a torque acting in a direction to displace the rotation phase to the retarded side are alternately generated.

Thus, for example, in the case where sphere 22 was caught in a bottom portion of spiral guide groove 28 to be fixed, sphere 22 is swung back and forth along spiral guide groove 28, and gets out of the bottom portion due to such swinging, so that the fixed condition is released.

If the alternate power supply is executed for the driving time, then control proceeds to step S10, where it is judged whether or not the advance value is changed by a predetermined angle or more.

If the advance value is changed by the predetermined angle or more, it is judged that the fixed condition was released, to terminate the control routine, and the normal feedback control is resumed from the next time.

On the other hand, if the release of the fixed condition is not judged in step 10, control proceeds to step S11, where it is judged whether or not the alternate power supply based on the driving time is performed for predetermined number of times or more.

If the number of execution times of the alternate power supply is less than the predetermined number of times, the control is made to stand by for a predetermined stop time in step S12, and thereafter, the control returns step S8 to perform the forcible driving repeatedly in intermittent.

Note, the constitution may be such that, when the alternate power supply is repeatedly performed, the duty ratio of electromagnetic brakes 26 and 27 is increased stepwise for each repetition, so that at first the release of the fixed condition is tried by a relatively small generated torque, and if the fixed condition cannot be released, it is judged that a more larger torque is necessary, to increase the generated torque.

If it is judged that the alternate power supply based on the driving time was performed for the predetermined number of times or more in step S11, even if the alternate power supply is performed for the predetermined number of times, the fixed condition cannot be released. In this case, it is judged that a failure occurs wherein the fixed condition cannot be released, and the control proceeds to step S13 to judge the failure.

When the failure is judged, fail-safe processes are executed such that the normal feedback control is inhibited while notifying the failure judgment to a driver by means of a lamp or the like, and further, second electromagnetic brake 27 that relatively rotates guide plate 24 to the retarded side of the rotation phase is made to be regularly supplied with the power.

In the above embodiment, the constitution has been such that guide plate 24 is relatively rotated in the advance direction and in the retarded direction by means of braking forces of two electromagnetic brakes. However, also in a variable valve timing mechanism having a constitution where guide plate 24 is urged to the retarded direction of the rotation phase by means of a resilient body, and guide plate 24 is relatively rotated in the advance direction of the rotation phase against the urging force by means of braking force of electromagnetic brake, it is also possible to achieve the release of the fixed condition in the same way.

That is, in the case of the above variable valve timing mechanism, at the time when the rotation phase becomes in a fixed condition, if the operating condition and the operation stopped condition of electromagnetic brake are repeated periodically, the torque is generated alternately in the advance direction and the retarded direction of the rotation phase, thereby capable of achieving the release of the fixed condition occurred when the movable part was caught.

Further, also in a constitution where a step motor is used as an actuator that relatively rotates guide plate 24, by setting alternately a step change amount in the advance direction and a step change amount in the retarded direction, the torque is generated alternately in the advance direction and the retarded direction of the rotation phase, thereby capable of achieving the release of the fixed condition occurred when the movable part was caught.

Moreover, the variable valve timing mechanism is not limited to such a constitution where the assembling angle is changed by the engagement of spiral guide groove 28 with link arm 14, but may have a constitution where the assembling angle is changed by other mechanism.

While only a selected embodiment has been chosen to illustrate the present invention, it will be apparent to those skilled in the art from this disclosure that various changes and modifications can be made herein without departing from the scope of the invention as defined in the appended claims.

Furthermore, the foregoing description of the embodiment according to the present invention is provided for illustration only, and not for the purpose of limiting the invention as defined in the appended claims and their equivalents.

What is claimed are:

1. A control apparatus of a variable valve timing mechanism that changes a rotation phase of a camshaft with respect to a crankshaft by an actuator to vary valve timing of engine valves, comprising:

a fixed condition detector that detects a fixed condition of said rotation phase; and a control unit that controls said actuator according to a target value of said rotation phase, and also, when the fixed condition of said rotation phase is detected, forcibly drives said actuator, to generate a torque alternately in an advance direction and a retarded direction of said rotation phase.

2. A control apparatus of a variable valve timing mechanism according to claim 1, wherein said fixed condition detector;

judges the fixed condition of said rotation phase, if an absolute value of a deviation between the target value of said rotation phase and an actual rotation phase is a predetermined value or above, at a point of time when a predetermined time of period has elapsed after the target value of said rotation phase was changed stepwise.

3. A control apparatus of a variable valve timing mechanism according to claim 1, wherein said control unit;

changes at least one of a generated torque, a driving period and a driving time for when forcibly driving said actuator, according to engine operating conditions.

4. A control apparatus of a variable valve timing mechanism according to claim 1, wherein said actuator of the variable valve timing mechanism is an electromagnetic brake, and said control unit;

changes at least one of a generated torque, a driving period and a driving time for when forcibly driving said actuator, according to an engine rotation speed.

5. A control apparatus of a variable valve timing mechanism according to claim 1, wherein said actuator of the variable valve timing mechanism is an electromagnetic brake, and said control unit;

corrects a drive current control signal in forcible driving of said actuator, according to a coil temperature of said electromagnetic brake.

6. A control apparatus of a variable valve timing mechanism according to claim 1, wherein said control unit;

limits a control signal in forcible driving of said actuator, according to an actual rotation phase for when forcibly driving said actuator.

7. A control apparatus of a variable valve timing mechanism according to claim 1, wherein said control unit;

stops forcible driving for a predetermined stop time after forcibly driving said actuator for a predetermined execution time, and again forcibly drives said actuator after the lapse of said predetermined stop time.

8. A control apparatus of a variable valve timing mechanism according to claim 7, wherein said control unit increases a generated torque of said actuator whenever repeating forcible driving of said actuator.

9. A control apparatus of a variable valve timing mechanism according to claim 7, wherein said control unit;

outputs a judgment signal indicating a failure of said variable valve timing mechanism, when the rotation phase is not changed even though the forcible driving of said actuator is repeated for a predetermined number of times or more.

10. A control apparatus of a variable valve timing mechanism according to claim 1, wherein said variable valve timing mechanism is constituted so that:

a driving rotor on the crankshaft side and a driven rotor on the camshaft side are coaxially connected with each other via a link arm;

one end of said link arm is connected with either said driving rotor or said driven rotor so as to be movable in radial; and a guide plate formed thereon with a spiral guide groove with which the one end of said link arm is fitted is relatively rotated with respect to said driving rotor by said electromagnetic brake to transfer the one end of said link arm in radial, to change an assembling angle between said driving rotor and said driven rotor.

11. A control apparatus of a variable valve timing mechanism that changes a rotation phase of a camshaft with respect to a crankshaft by an actuator to vary valve timing of engine valves, comprising:

fixed condition detecting means for detecting a fixed condition of said rotation phase; and fixed condition releasing means for, when the fixed condition of said rotation phase is detected, forcibly driving said actuator, to generate a torque alternately in an advance direction and a retarded direction of said rotation phase.

12. A control method of a variable valve timing mechanism that changes a rotation phase of a camshaft with respect to a crankshaft by an actuator to vary valve timing of engine valves, comprising the steps of:

detecting a fixed condition of said rotation phase; and when the fixed condition of said rotation phase is detected, forcibly driving said actuator, to generate a torque alternately in an advance direction and a retarded direction of said rotation phase.

13. A control method of a variable valve timing mechanism according to claim 12, wherein said step of detecting the fixed condition comprises the steps of:

measuring an elapsed time after the target value of said rotation phase was changed stepwise;

calculating, when said elapsed time reaches a predetermined time, a deviation between the target value of said rotation phase and an actual rotation phase at that time; and judging the fixed condition of said rotation phase when an absolute value of said deviation is a predetermined value or above.

14. A control method of a variable valve timing mechanism according to claim 12, wherein said step of forcibly driving said actuator comprises the steps of:

detecting engine operating conditions; and changing at least one of a generated torque, a driving period and a driving time for when forcibly driving said actuator, according to the engine operating conditions.

15. A control method of a variable valve timing mechanism according to claim 12, wherein said actuator of the variable valve timing mechanism is an electromagnetic brake, and said step of forcibly driving said actuator comprises the steps of:

detecting an engine rotation speed; and changing at least one of a generated torque, a driving period and a driving time for when forcibly driving said actuator, according to the engine rotation speed.

16. A control method of a variable valve timing mechanism according to claim 12, wherein said actuator of the variable valve timing mechanism is an electromagnetic brake, and said step of forcibly driving said actuator comprises the steps of:

detecting a coil temperature of said electromagnetic brake; and correcting a drive current control signal in forcible driving of said actuator, according to said coil temperature.

17. A control method of a variable valve timing mechanism according to claim 12, wherein said step of forcibly driving said actuator comprises the steps of:

detecting an actual rotation phase for when forcibly driving said actuator; and limiting a control signal in forcible driving of said actuator, according to said actual rotation phase.

18. A control method of a variable valve timing mechanism according to claim 12, wherein said step of forcibly driving said actuator comprises the steps of:

measuring a forcible driving time of said actuator;

suspending said forcible driving when said forcibly driving time reaches a predetermined execution time;

measuring a suspended time of said forcible driving; and resuming said forcible driving when said suspended time reaches a predetermined stop time.

19. A control method of a variable valve timing mechanism according to claim 12, wherein said step of forcibly driving said actuator comprises the steps of:

measuring a forcible driving time of said actuator;

suspending said forcible driving when said forcibly driving time reaches a predetermined execution time;

measuring a suspended time of said forcible driving;

resuming said forcible driving when said suspended time reaches a predetermined stop time; and increasing a generated torque in forcible driving of said actuator whenever repeating forcibly driving said actuator.

20. A control method of a variable valve timing mechanism according to claim 12, wherein said step of forcibly driving said actuator comprises the steps of:

measuring a forcible driving time of said actuator;

suspending said forcible driving when said forcibly driving time reaches a predetermined execution time;

measuring a suspended time of said forcible driving;

resuming said forcible driving when said suspended time reaches a predetermined stop time; and outputting a judgment signal indicating a failure of said variable valve timing mechanism when the rotation phase is not changed even though said forcible driving is repeated for a predetermined number of times.

* * * * *